US010034535B1

(12) United States Patent
LaForest et al.

(10) Patent No.: US 10,034,535 B1
(45) Date of Patent: Jul. 31, 2018

(54) SLEEPING BAG CONVERTIBLE INTO A BACKPACK

(71) Applicant: mimish, Inc., Brooklyn, NY (US)

(72) Inventors: Jennifer M. LaForest, Brooklyn, CA (US); Andrea Soto-Camacho, Brooklyn, NY (US); James R. Arrufat, Brooklyn, NY (US)

(73) Assignee: mimish, Inc., Brooklyn, NY (US)

( * ) Notice: Subject to any disclaimer, the term of this patent is extended or adjusted under 35 U.S.C. 154(b) by 0 days.

(21) Appl. No.: 15/820,997

(22) Filed: Nov. 22, 2017

(51) Int. Cl.
*A45F 4/08* (2006.01)
*A45F 3/04* (2006.01)
*A47G 9/08* (2006.01)

(52) U.S. Cl.
CPC ..... *A45F 4/08* (2013.01); *A45F 3/04* (2013.01); *A47G 9/086* (2013.01); *A47G 9/08* (2013.01)

(58) Field of Classification Search
CPC ..... A45F 3/04; A45F 4/06; A45F 4/08; A47G 9/08; A47G 9/086
USPC ..... 224/153, 155, 156
See application file for complete search history.

(56) References Cited

U.S. PATENT DOCUMENTS 672,731 A * 4/1901 Conley ..... A41D 15/04 135/115
748,288 A * 12/1903 Klein ..... A47G 9/086 224/156
4,634,618 A * 1/1987 Greer ..... A47G 9/062 383/127
5,404,600 A * 4/1995 DeMars ..... A45F 4/02 5/413 R
5,454,643 A * 10/1995 Sullivan ..... A45C 3/10 383/127
5,785,219 A * 7/1998 Kraft ..... A45F 4/02 2/66
6,243,892 B1 * 6/2001 Kelling ..... A45F 4/06 224/153
6,343,968 B1 2/2002 Louie et al.
6,393,638 B1 * 5/2002 MacColl ..... A45F 4/02 383/4
D470,655 S 2/2003 Smith
6,901,614 B2 * 6/2005 Holub ..... A47G 9/086 5/413 R
7,028,870 B2 * 4/2006 Valdez-Campbell ..... A45C 7/0095 224/153
7,058,997 B1 6/2006 Klinger
(Continued)

*Primary Examiner* — Justin Larson
(74) *Attorney, Agent, or Firm* — Sheppard, Mullin, Richter & Hampton, LLC

(57) ABSTRACT

This invention provides an improved sleeping bag convertible into a backpack with reduced complexity and greater ease of use. The sleeping bag includes (1) an elongated flexible bag; (2) a flexible pouch attached to the bag at or near the bag's lower end; (3) left and right shoulder straps, each having a lower section attached to the bag at the bag's lower end and an upper section attached to the bag at a location spaced from the bag's lower end; and (4) a side attachment assembly for releasably attaching the left side edge of the bag to the right side of the bag, adjacent to the pouch. The bag is configured to be storable within the pouch by (a) folding the bag along a central longitudinal axis, (b) folding the bag lengthwise into the pouch via the pouch's open upper end, and (c) attaching the side attachment assembly, after which the sleeping bag can be worn as a backpack on a person's shoulders.

11 Claims, 9 Drawing Sheets

(56) References Cited

U.S. PATENT DOCUMENTS

| | | | | |
|---|---|---|---|---|
| 7,076,816 | B1 * | 7/2006 | Nielsen | A47G 9/062 297/188.06 |
| D551,891 | S * | 10/2007 | Kaiser | D6/595 |
| D553,356 | S | 10/2007 | Frago | |
| D569,673 | S * | 5/2008 | Gostt | D6/595 |
| 7,516,500 | B2 * | 4/2009 | Akkad | A45F 4/02 383/4 |
| D708,422 | S * | 7/2014 | Trent | D2/719 |
| 9,226,565 | B1 * | 1/2016 | Martin | A45F 4/06 |
| 2002/0088830 | A1 * | 7/2002 | Rose | A45C 9/00 224/153 |
| 2004/0155077 | A1 * | 8/2004 | Cullen | A45C 3/10 224/153 |
| 2008/0054032 | A1 * | 3/2008 | Jones | A45F 4/06 224/156 |
| 2008/0277435 | A1 * | 11/2008 | Jones | A45F 4/06 224/156 |

* cited by examiner

SLEEPING BAG CONVERTIBLE INTO A BACKPACK

BACKGROUND OF THE INVENTION

Field of the Invention

This invention relates generally to sleeping bags and, more particularly, to sleeping bags configured to be convertible into backpacks.

Description of the Prior Art

Sleeping bags have been in common use for centuries, typically having a rectangular shape, with a closed lower end, closed left and right side edges, and an open upper end. This defines an internal chamber sized to receive a human body for sleeping. A zipper typically defines the sleeping bag's lower end and one of its side edges, to allow the bag to be selectively opened up into a blanket.

When not in use, the sleeping bag typically is stored by rolling it lengthwise into a cylinder for manual placement into a cylindrical carrying pouch or simply for tying into a cylindrical bundle. When camping or backpacking, the cylindrical pouch or bundle sometimes is attached by straps to a separate backpack for transport.

To eliminate the need for a separate backpack, some sleeping bags have been configured themselves to include a pouch and shoulder straps, enabling the sleeping bag to be converted into a backpack for transport. Such convertible sleeping bags are particularly useful for children traveling to and from overnight "sleepovers" with friends. Although prior convertible sleeping bags have generally been useful and effective, their conversion from a sleeping bag into a backpack is considered unduly difficult.

It should be appreciated that there is a continuing need for an improved sleeping back convertible into a backpack, with reduced complexity and greater ease of use. The present invention fulfills that need.

SUMMARY OF THE INVENTION

The present invention is embodied in an improved sleeping bag convertible into a backpack with reduced complexity and greater ease of use. The sleeping bag includes (1) an elongated flexible bag having a lower end, left and right side edges, and an open upper end accessing an interior chamber sized to receive a human body for sleeping; (2) a flexible pouch attached to the bag at or near the bag's lower end, adjacent to one of the bag's left and right side edges, wherein the pouch has a closed lower end, closed left and right sides, and an open upper end; (3) a left shoulder strap having a lower section attached to the bag at the bag's lower end and an upper section attached to the bag at a location spaced from the bag's lower end, (4) a right shoulder strap having a lower section attached to the bag at the bag's lower end and an upper section attached to the bag at a location spaced from both the bag's lower end and from the attachment location of the left shoulder strap's upper section; and (5) a side attachment assembly for releasably attaching the left side edge of the bag to the right side of the bag, adjacent to the pouch. The bag is configured to be storable within the pouch by (a) folding the bag along a central longitudinal axis, (b) folding the bag lengthwise into the pouch via the pouch's open upper end, and (c) attaching the side attachment assembly, after which the sleeping bag can be worn as a backpack on a person's shoulders.

In other, more detailed features of the invention, the left and right shoulder straps each further include a releasable fastener allowing its lower and upper sections to be selectively fastened together. The upper sections of the left and right shoulder straps are preferably are attached to the bag at locations substantially aligned with the pouch's open upper end.

The sleeping bag preferably has a generally rectangular shape, with a substantially uniform width, and the pouch preferably has a generally rectangular shape having a substantially uniform width about half that of the bag. The side attachment assembly can include lower and upper detachable connectors, each having (1) a first section attached to the left side edge of the bag, (2) a second section attached to the right side of the bag, and (3) an attachment member for selectively attaching together the first and second sections. These lower and upper detachable connectors each can be configured such that either its first section or its second section is attached to the bag at the location of a side edge of the pouch.

In another optional feature of the invention, the sleeping bag can further include a drawstring closure device for selectively reducing the size of the pouch's open upper end, to secure the bag within the pouch. The sleeping bag also can further include a closure flap secured to the bag at a location spaced from the bag's lower end and to the side of the pouch's open upper end, wherein the closure flap is configured to be foldable over the pouch's open upper end after the bag has been folded and inserted therethrough. A fastener can be provided for securing the flap in a folded-over position, wherein the fastener includes a first section attached to the closure flap and a second section attached to the pouch. In yet another optional feature, the sleeping bag can include a zipper for selectively closing the bag's lower end and one of the bag's two left and right side edges.

Other features and advantages of the present invention should be apparent from the following description of the preferred embodiment, taken in conjunction with the accompanying exemplary drawings, which illustrate the principles of the invention.

BRIEF DESCRIPTION OF THE DRAWINGS

FIG. 3 shows the convertible sleeping bag's rear side, with one side folded under other along a central axis.

FIG. 4 shows the convertible sleeping bag's rear side as the bag's upper end is begun to be folded over itself.

FIG. 5 shows the convertible sleeping bag's rear side after the bag has been folded partially into the pouch's open upper end.

FIG. 6 shows the convertible sleeping bag's rear side after the bag has been folded completely into the pouch.

FIG. 7 shows the convertible sleeping bag's rear side after the upper and lower side attachment assemblies have been attached and after a closure flap and fastener have been fastened.

FIG. 8 shows the convertible sleeping bag's front side, from a lower right perspective, with the left and right shoulder straps detached, but in alignment.

FIG. 9 shows the convertible sleeping bag's front side, from an upper left perspective, with the shoulder straps attached together and forming a completed backpack suitable to be worn on a person's shoulders.

DESCRIPTION OF THE PREFERRED EMBODIMENT

Figure 1:
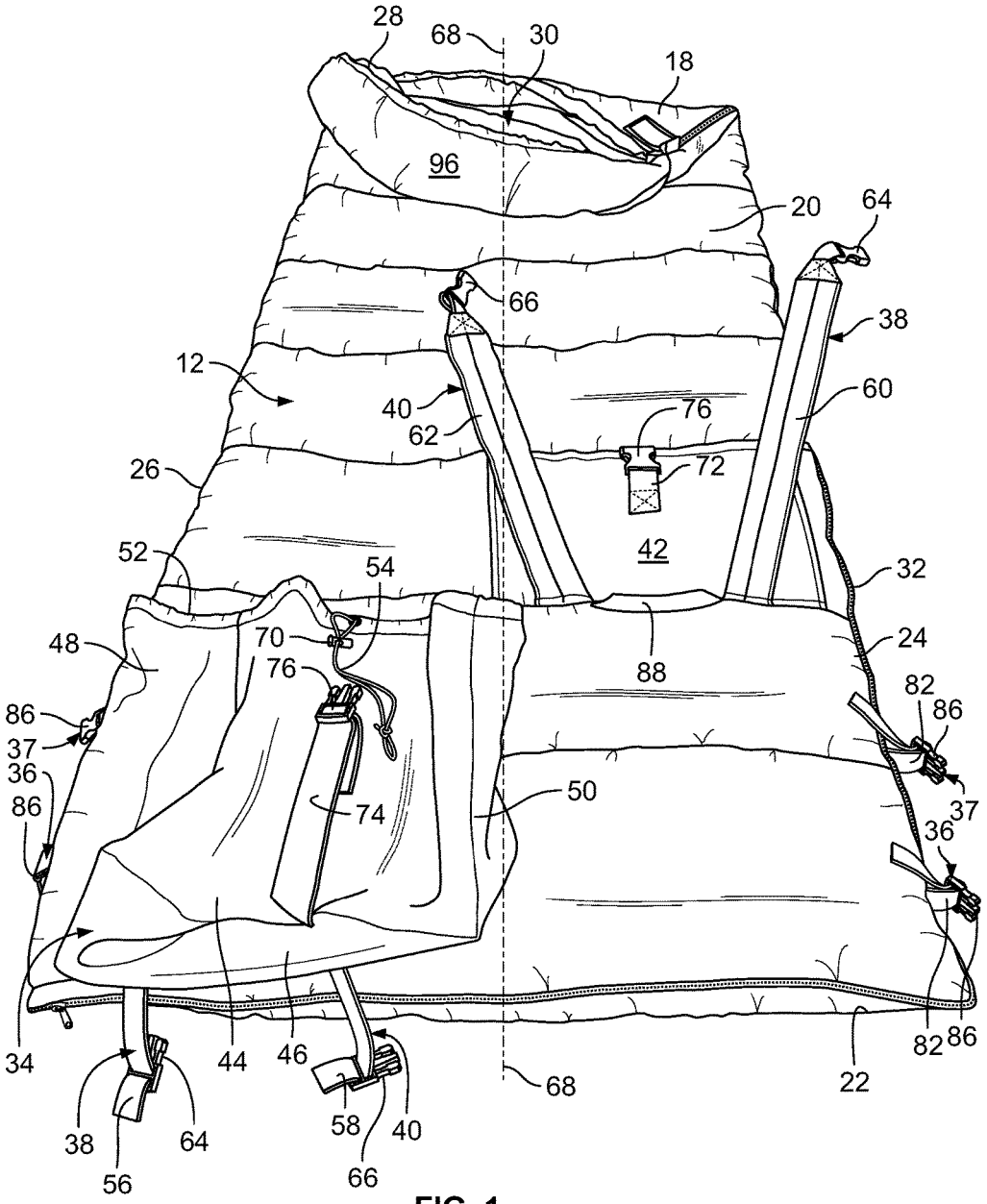
FIG. 1 is a perspective view of a sleeping bag convertible into a backpack in accordance with a preferred embodiment of the invention, showing the rear side of the sleeping bag in its open configuration.
Figure 7:
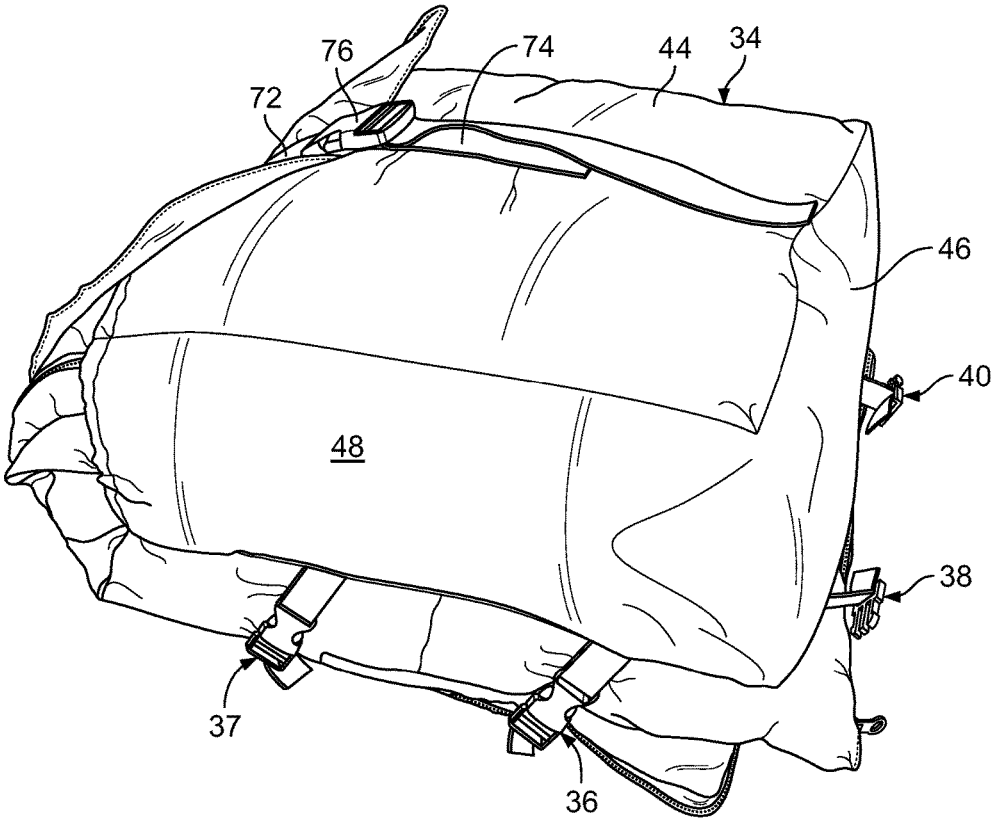
Figure 9:
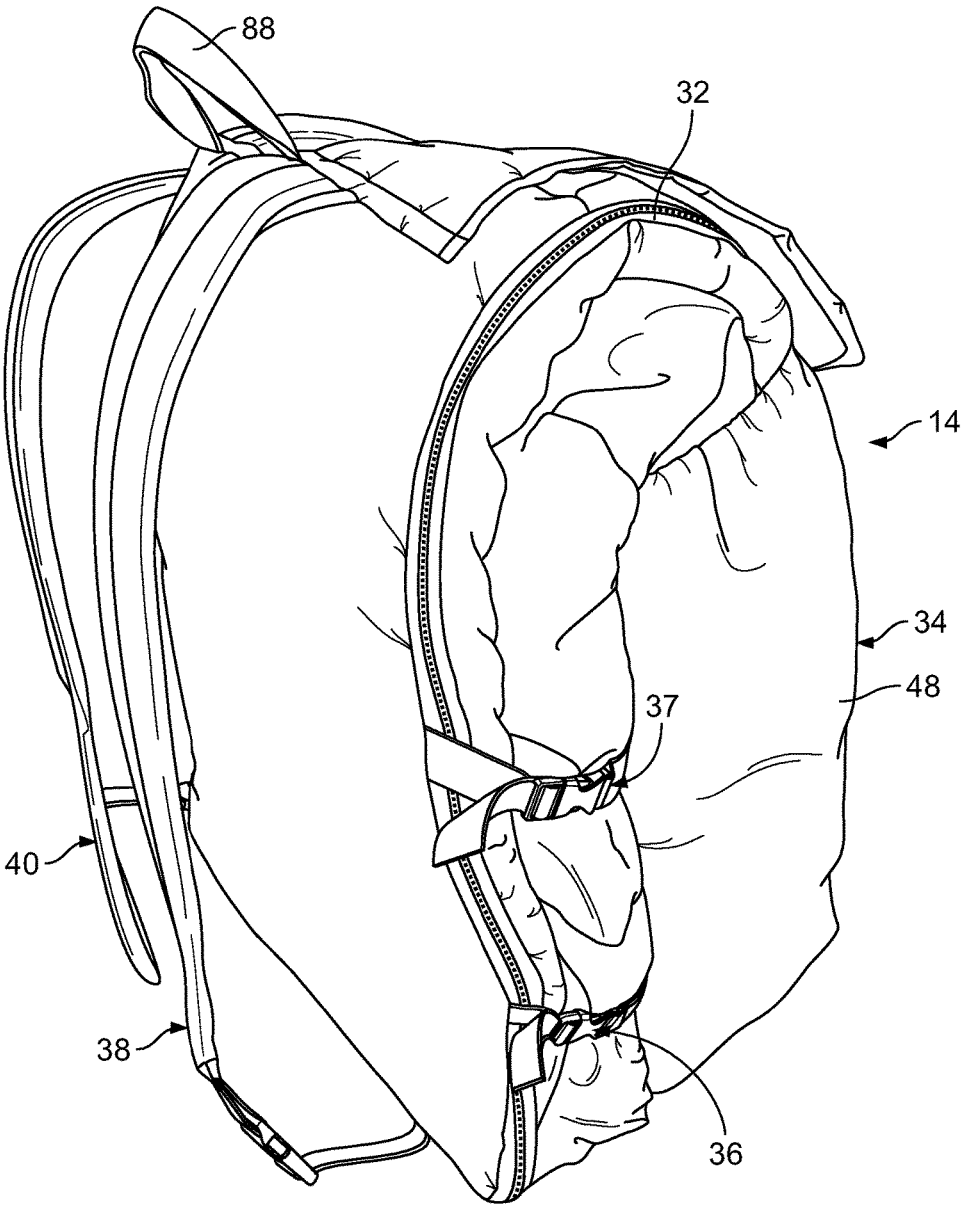

With reference now to the exemplary drawings, and particularly to FIGS. 1, 7 and 9, there is shown a sleeping bag 12 (FIG. 1) configured to be convertible into a backpack 14 (FIG. 9) for carrying over a person's shoulders. The conversion is readily performed without difficulty or complicated steps, and the components that allow the sleeping bag to be used as a backpack do not interfere with its function as a sleeping bag.

The sleeping bag 12 has a generally rectangular shape, with a front side 18 (FIG. 2) and a rear side 20 (FIG. 1), and with a lower end 22, a left side edge 24, a right side edge 26, and an upper end 28. (Note that FIG. 1 depicts the sleeping bag's rear side, so the left side edge 24 is rightward and the right side edge 26 leftward.) The bag's upper end is open (see FIGS. 1 and 2), to allow access to a generally rectangular interior cavity 30 sized to receive a human body (not shown) for sleeping. As is conventional, a zipper 32 connects the bag's front and rear sides along the lower end 22 and one side edge, in this case the left side edge 24. Opening the zipper fully allows the sleeping bag to be opened up into a generally square-shaped blanket (not shown).

Structure for use in converting the sleeping bag 12 (FIG. 1) into a backpack 14 (FIG. 9) includes (1) a flexible pouch 34; (2) a side fastener assembly comprising a lower side fastener 36 and an upper side fastener 37; (3) a shoulder strap assembly comprising a left shoulder strap 38 and a right shoulder strap 40; and (4) a closure flap 42.

The flexible pouch 34 is secured (preferably by stitching) to the lower, left portion of the sleeping bag's rear side 20, with a front wall 44, a bottom wall 46, a left side wall 48, and a right side wall 50. The pouch's upper end 52 is open. The pouch's walls cooperate with the adjacent portion of the sleeping bag's rear side 20 to define an open interior, which is sized to receive the bag 12 in a folded condition. A drawstring 54 extends through a narrow channel formed around the upper end's periphery, for use in closing off the opening and securing the bag within the pouch after its insertion.

The left shoulder strap 38 and right shoulder strap 40 include sections that are secured to the sleeping bag 12 at seemingly disparate locations. However, as the sleeping bag is folded into a compact shape for insertion into the pouch 34, these strap components come into alignment with each other and facilitate the conversion of the sleeping bag into a backpack 14.

More particularly, the left shoulder strap 38 and the right shoulder strap 40 include lower sections 56 and 58, respectively, that attach to the sleeping bag 12 at the bag's lower end 22, preferably about 4 inches and 12 inches, respectively, from the bag's right side edge 26. Preferably, these lower sections are sewn between the bag's rear side 20 and the pouch's bottom wall 46.

The left shoulder strap 38 and the right shoulder strap 40 further include upper sections 60 and 62, respectively, that attach to the sleeping bag 12 on the lower right portion of the bag's rear side 20, in substantial alignment with the open upper end 52 of the pouch 34. Preferably, these left and right upper sections are located about 12 and 4 inches, respectively, from the bag's left side edge 24, and about 18 inches from the bag's lower end 22.

Figure 8:
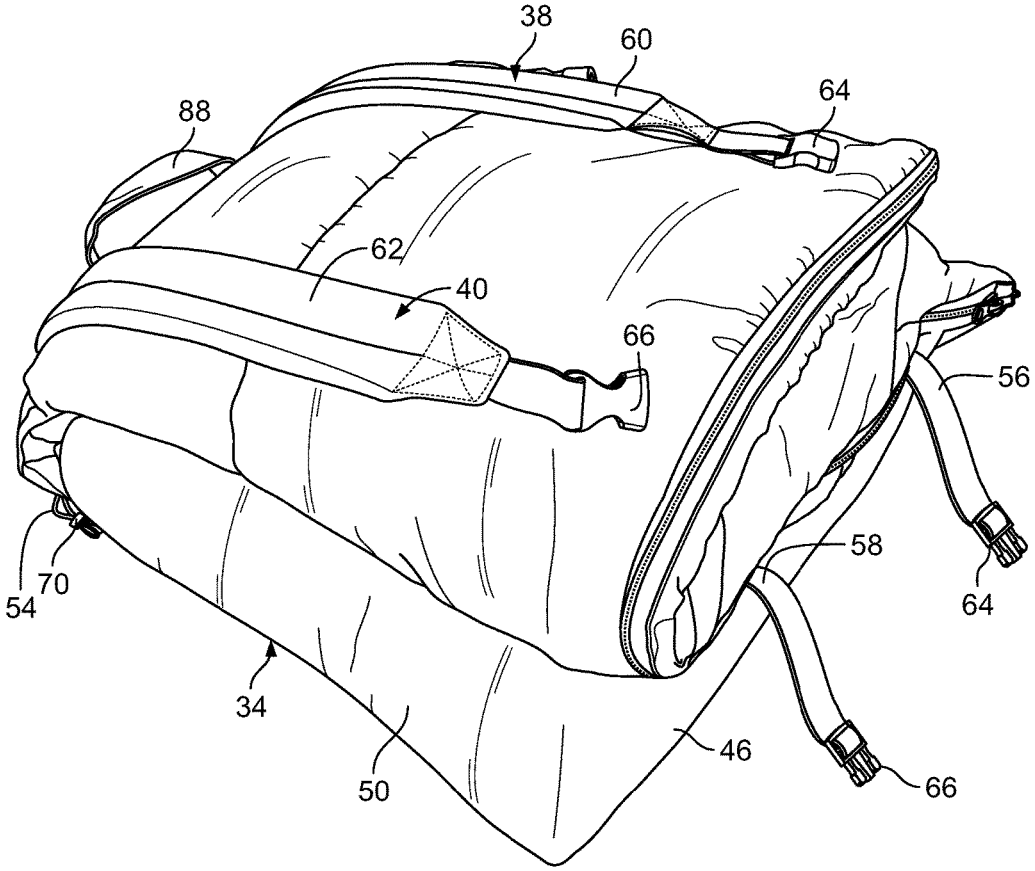

The left shoulder strap 38 and the right shoulder strap 40 also further include conventional quick-release fasteners 64 and 66, respectively (see FIGS. 8 and 9). This facilitates a convenient fastening and unfastening of the upper and lower strap sections, to form completed straps secured at their ends to the sleeping bag 12. The straps thereby can function as conventional shoulder straps when in the sleeping bag has been converted into its backpack configuration.

Converting the sleeping bag 12 into a backpack 14 requires just a few simple steps. These steps are depicted sequentially in FIGS. 3-9.

Figure 2:
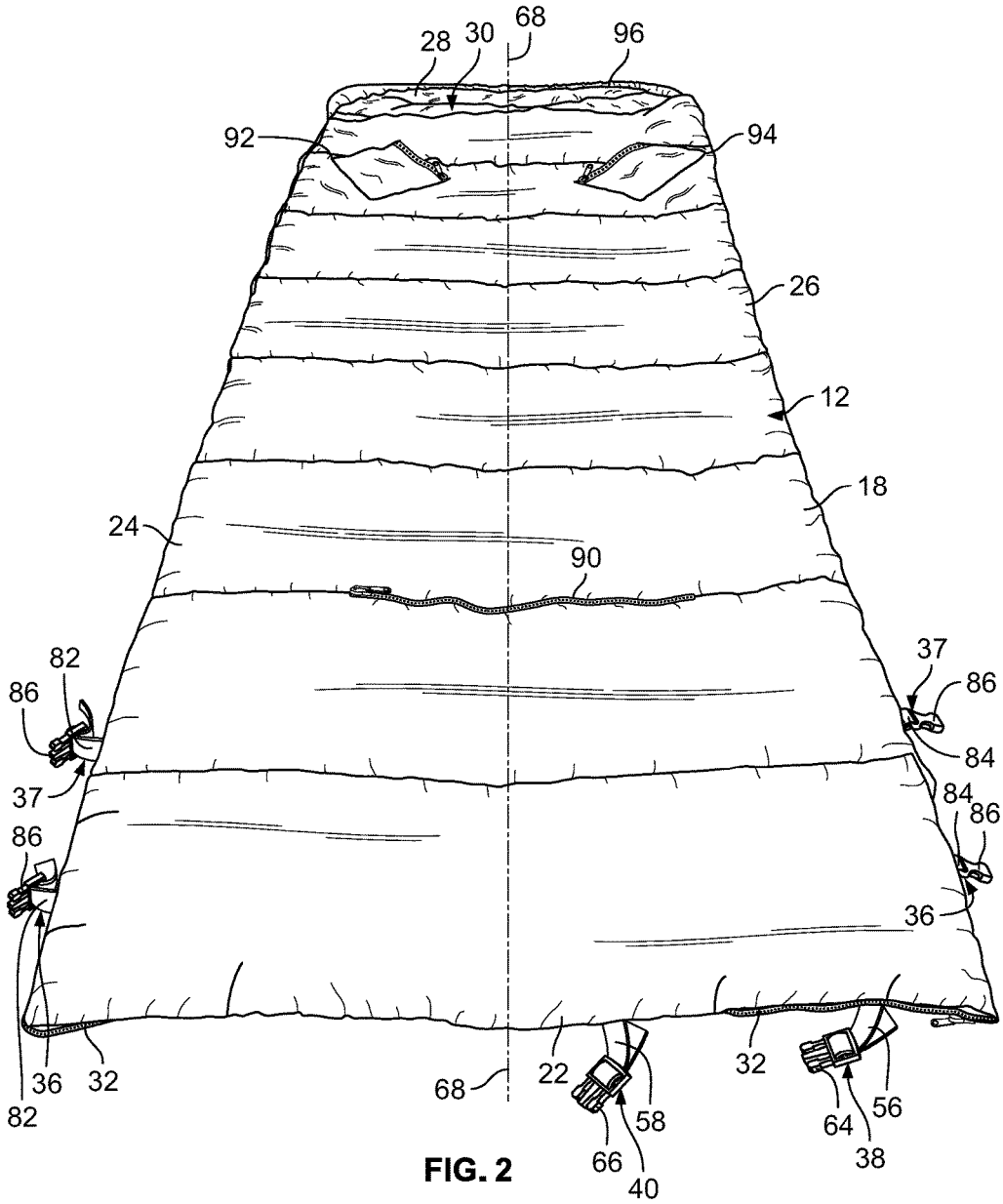
FIG. 2 is a perspective view of the convertible sleeping bag of FIG. 1, showing the front side of the sleeping bag in its open configuration.
Figure 3:
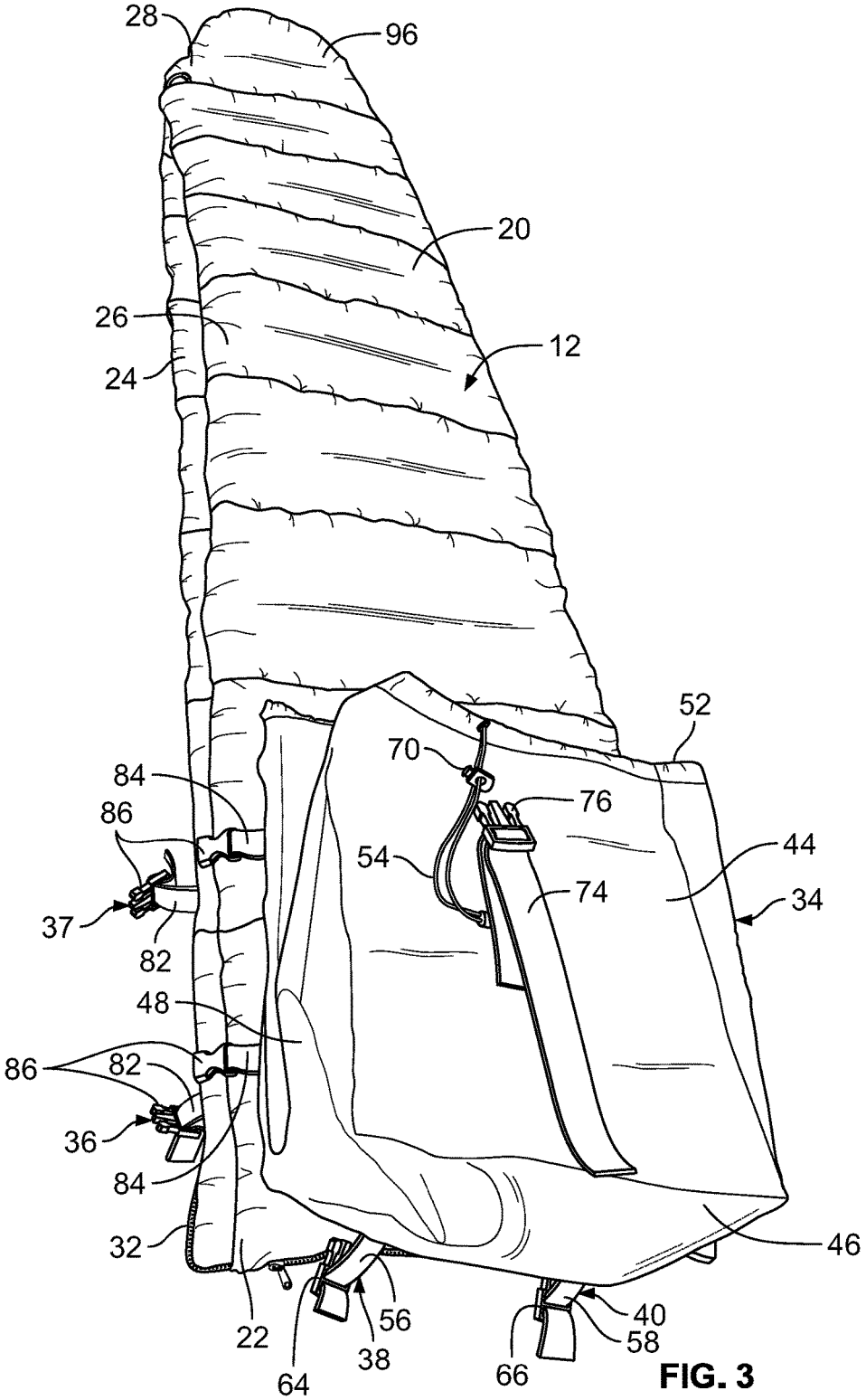
FIGS. 3-9 all are perspective views of the convertible sleeping bag of FIG. 1, showing the sequence of steps for its conversion into a backpack. More particularly.
Figure 4:
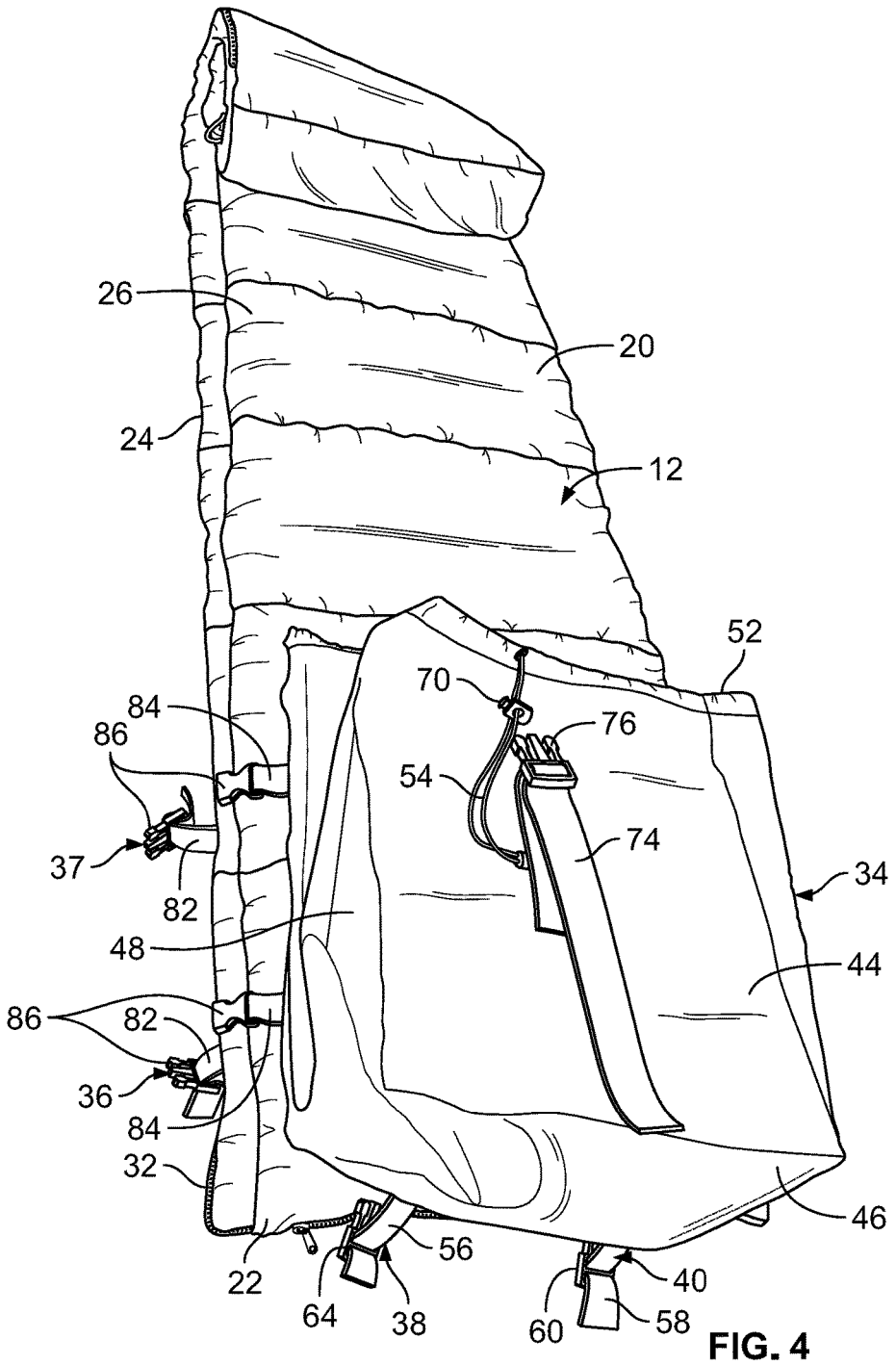
Figure 5:
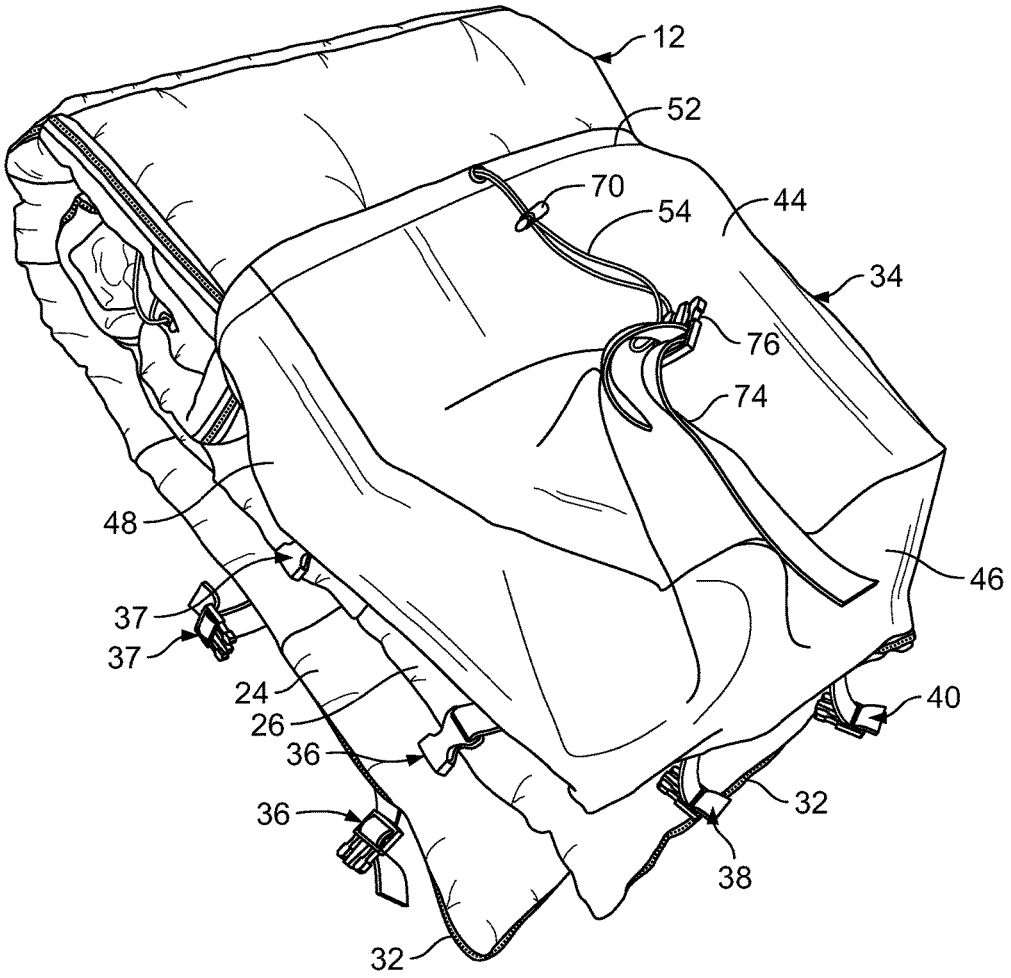
Figure 6:
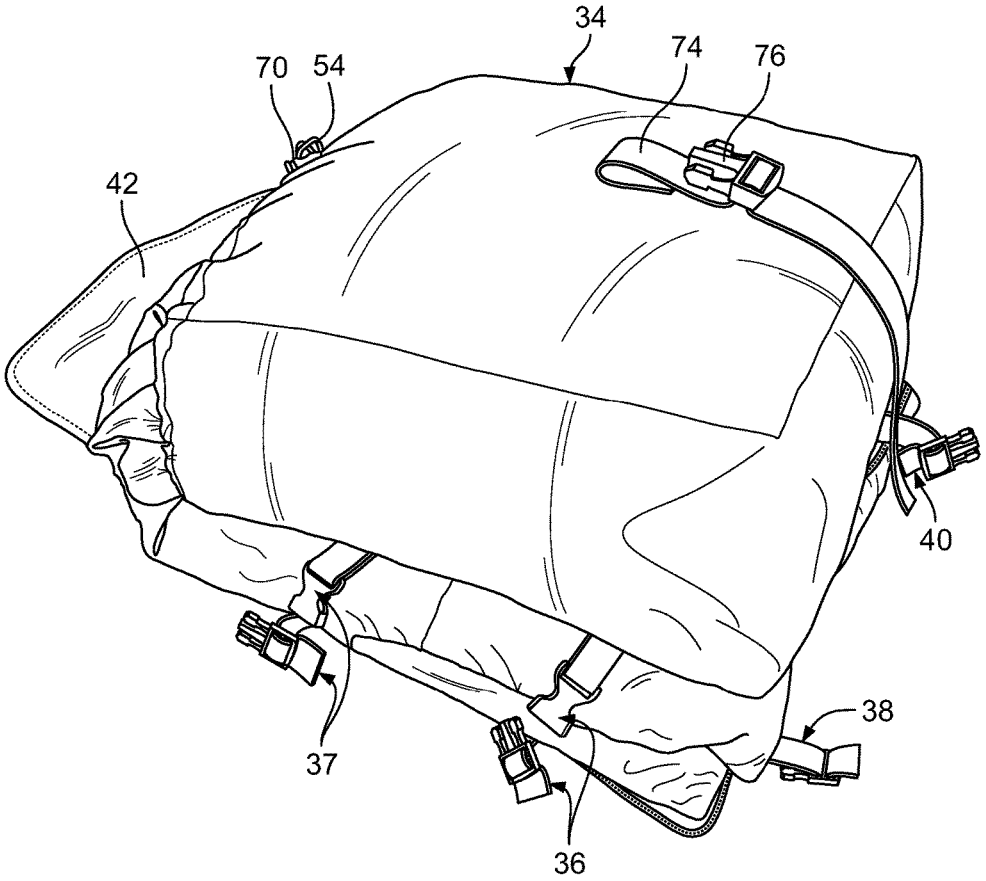

With reference initially to FIG. 3, the bag first is folded along a central, longitudinal axis 68 (FIGS. 1 and 2), with its left side folded beneath its right side such that the pouch 34 now occupies the bag's entire lower end. Then, as shown in FIG. 4, the sleeping bag is folded (or rolled) toward the bag's lower end 22 and the pouch, beginning at the bag's upper end 28. After this folding has reached the pouch (see FIG. 5), the folded bag is simply inserted into the pouch's open upper end (see FIG. 6). As an alternative to folding or rolling, the sleeping bag even could simply be stuffed randomly into the bag.

To further secure the folded sleeping bag 12 within the pouch 34, the drawstring 54 can be tightened to reduce the size of the pouch's open upper end 44. This drawstring is best visible in FIGS. 3-5. A conventional spring-biased clamp 70 is mounted at the end of the drawstring, to allow the drawstring to be pulled tight and locked in place. This secures the folded sleeping bag within the pouch's interior space. Subsequently releasing the clamp allows the drawstring to be loosened, thereby allowing the sleeping bag to be selectively removed from the pouch.

Yet further securement of the folded sleeping bag 12 within the pouch 34 is achieved by the closure flap 42, which is mounted on the bag immediately above the attachment points of the upper sections 60 and 62 of the left and right shoulder straps 38 and 40, respectively (see FIG. 1). After the sleeping bag has been folded into the pouch and the drawstring 54 has been tightened, the closure flap projects outward from the bag at a location immediately above the pouch. A releasable strap assembly includes (1) an upper strap section 72 secured to the flap at a mid-portion of its outside surface, (2) a lower strap section 74 secured to the front wall 44 of the pouch at a mid-portion of its outside surface, and (3) a releasable fastener, or buckle 76 to facilitate a rapid connection or disconnection of the two strap sections. When fastened, the sleeping bag is securely retained within the pouch. As is conventional, the releasable fastener can be configured to allow the strap assembly's overall length to be selectively shortened or lengthened.

With reference again to FIG. 6, it will be appreciated that after the sleeping bag 12 has been inserted into the pouch 34, the lower left and lower right portions of the bag remain outside the pouch at this time. The lower left portion forms the pouch's rear wall, and the lower right portion is simply positioned loosely at the front side of the lower left portion. This lower right portion can be secured in this position and prevented from swinging freely by the side attachment assembly, which includes the lower and upper side fasteners 36 and 37, respectively. Each such fastener includes a front section 82, a rear section 84, and a quick-release mechanism 86. The front sections are attached to the bag's left side edge 24, and the rear sections are attached to the bag's right side edge 26, in positions that align with each other when the sleeping bag is folded and inserted into the pouch, as described above. When the quick-release mechanisms are fastened, the entire unit forms a compact, secure structure.

After the closure flap 42 and the side attachment fasteners 36 and 37 have been fastened, the lower sections 56, 58 and the upper sections 60, 62 of the respective left and right shoulder straps 38 and 40 are aligned with each other. Thus, fastening the quick-release fasteners 64 and 66 makes the left and right shoulder straps unitary. This is depicted in FIG. 9.

It will be appreciated that, when the sleeping bag 12 has been converted into a backpack 14 and is being carried on a person's shoulders, the portion of the backpack directly contacting the person's back will be the lower right portion of sleeping bag. This portion is smooth and padded, thereby enhancing comfort.

A handle 88 is secured to the sleeping bag 12 at a location between the attachment points of the upper sections 60, 62 of the respective left and right shoulder straps 38, 40. In this location, the handle projects upward from the center of the backpack 14, for convenient one-handed carrying. The handle can take the simple form of a short length of sturdy 100% polyester webbing.

When the sleeping bag 12 is in its open configuration, suitable for use in its normal use in sleeping, as shown in FIG. 2, it will be appreciated that all of the components used for its conversion into a backpack all are located alongside or beneath the bag. In this way, those components do not interfere with the user's sleeping. Moreover, all of these components are securely attached to the sleeping bag, itself. This prevent misplacement or loss of those components.

Several optional features of the invention are depicted in FIG. 2. These include three zippered storage pockets in the sleeping bag's front side 18: a large pocket 90 located near the sleeping bag's lower end 22 and two small pockets 92 and 94 located at the sleeping bag's upper end 28. These pockets all have rectangular shapes, and they are sized to carry small articles typically needed by a child attending an overnight sleepover.

In addition, as best seen in FIGS. 1 and 2, the bag's rear side 20 extends beyond its front side 18, to form a hood, or cowling 96. This prevent dirts and other debris from entering the bag's interior.

The sleeping bag 12, itself, can be of conventional design and conventional materials. Typically the bag's shell and inner lining are formed of a durable, tear-resistant 190T polyester taffeta material, and the bag's interior filling is 100% polyester hollow fiber or goose down. The pouch 34 and closure flap 42 can be formed of the same polyester material as the bag's shell. The various strap sections can be formed of 100% polyester webbing, and the fasteners, or buckles, can be formed of polyoxymethylene plastic.

It should be appreciated from the foregoing detailed description of the preferred embodiment that the invention provides a useful sleeping bag configured to be convertible into a backpack for carrying on a user's shoulders. A pouch is mounted directly on the bag in a position such that the bag can be conveniently folded into it, and left and right shoulder straps also are mounted directly on the bag, such that their upper and lower sections come into alignment when the bag has been folded into the pouch. The conversion is accomplished using just a few simple steps, easily carried out, even by a child.

Although the invention has been described in detail with reference to the preferred embodiment, persons skilled in the art will appreciate that various modification and revisions can be made without departing from the invention. Accordingly, the invention is defined only by the following claims.

We claim:

1. A sleeping bag convertible into a backpack, comprising:

an elongated flexible bag having a lower end, left and right side edges, and an open upper end accessing an interior chamber sized to receive a human body for sleeping, wherein the bag defines a central axis extending lengthwise between its left and right side edges;

a flexible pouch attached to the bag at or near the bag's lower end, adjacent to one of the bag's left and right side edges, wherein the pouch has a closed lower end, closed left and right sides, and an open upper end;

a shoulder strap assembly having (1) a left shoulder strap having a lower section attached to the bag at the bag's lower end and an upper section attached to the bag at a location spaced from the bag's lower end, and (2) a right shoulder strap having a lower section attached to the bag at the bag's lower end and an upper section attached to the bag at a location spaced from both the bag's lower end and from the attachment location of the left shoulder strap's upper section; and a side attachment assembly for releasably attaching the left side edge of the bag to the right side of the bag, adjacent to the pouch;

wherein the bag is configured to be storable within the pouch by (1) folding the bag along its central axis, (2) folding the bag lengthwise into the pouch via the pouch's open upper end, and (3) attaching the side attachment assembly, after which the sleeping bag can be worn as a backpack on a person's shoulders.

2. The sleeping bag defined in claim 1, wherein the left and right shoulder straps each further include a releasable fastener allowing its lower and upper sections to be selectively fastened together.

3. The sleeping bag defined in claim 2, wherein the upper sections of the left and right shoulder straps are attached to the bag at locations substantially aligned with the pouch's open upper end.

4. The sleeping bag defined in claim 1, wherein:

the bag has a generally rectangular shape, with a substantially uniform width; and the pouch has a generally rectangular shape having a substantially uniform width about half that of the bag.

5. The sleeping bag defined in claim 4, wherein the side attachment assembly comprises lower and upper detachable connectors, each having (1) a first section attached to the left side edge of the bag, (2) a second section attached to the right side of the bag, and (3) an attachment member for selectively attaching together the first and second sections.

6. The sleeping bag defined in claim 5, wherein the lower and upper detachable connectors each are configured such that either its first section or its second section is attached to the bag at the location of a side edge of the pouch.

7. The sleeping bag defined in claim 1, and further comprising a drawstring closure device for selectively reducing the size of the pouch's open upper end, to secure the bag within the pouch.

8. The sleeping bag defined in claim 1, and further comprising a closure flap secured to the bag at a location spaced from the bag's lower end and to the side of the pouch's open upper end, wherein the closure flap is configured to be foldable over the pouch's open upper end after the bag has been folded and inserted therethrough.

9. The sleeping bag defined in claim 8, and further comprising a fastener for securing the flap in a folded-over position, wherein the fastener includes a first section attached to the closure flap and a second section attached to the pouch.

10. The sleeping bag defined in claim 1, and further comprising a zipper for selectively closing the bag's lower end and one of the bag's two left and right side edges.

11. A sleeping bag convertible into a backpack, comprising:

an elongated flexible bag having a generally rectangular shape, with a substantially uniform width, and with a lower end, left and right side edges, and an open upper end accessing an interior chamber sized to receive a human body for sleeping, wherein the bag defines a central axis extending lengthwise between its left and right side edges;

a flexible pouch having a generally rectangular shape with a substantially uniform width about half that of the bag, wherein the pouch is attached to the bag at or near the bag's lower end, adjacent to one of the bag's left and right side edges, wherein the pouch has a closed lower end, closed left and right sides, and an open upper end;

a shoulder strap assembly having (1) a left shoulder strap having a lower section attached to the bag at the bag's lower end, an upper section attached to the bag at a location spaced from the bag's lower end and aligned with the pouch's open upper end, and a releasable fastener allowing the upper and lower sections to be selectively fastened together, (2) a right shoulder strap having a lower section attached to the bag at the bag's lower end, an upper section attached to the bag at a location spaced from both the bag's lower end and from the attachment location of the left shoulder strap's upper section and aligned with the pouch's open upper end, and a releasable fastener allowing the upper and lower sections to be selectively fasted together;

a side attachment assembly for releasably attaching the left side edge of the bag to the right side of the bag, adjacent to the pouch wherein the side attachment assembly includes lower and upper detachable connectors, each having (1) a first section attached to the left side edge of the bag, (2) a second section attached to the right side of the bag, and (3) an attachment member for selectively attaching together the first and second sections; and a closure flap secured to the bag at a location spaced from the bag's lower end and to the side of the pouch's open upper end, wherein the closure flap is configured to be foldable over the pouch's open upper end after the bag has been folded and inserted therethrough;

wherein the bag is configured to be storable within the pouch by (1) folding the bag along its central axis, (2) folding the bag lengthwise into the pouch via the pouch's open upper end, and (3) attaching the side attachment assembly, after which the sleeping bag can be worn as a backpack on a person's shoulders.

* * * * *